United States Patent [19]

Ekonen et al.

[11] Patent Number: 5,060,936

[45] Date of Patent: Oct. 29, 1991

[54] ROPE JUMPING METHOD AND APPARATUS

[76] Inventors: Martin A. Ekonen, 29581 Puritan Ave., Livonia, Mich. 48154; William D. Suggett, P.O. Box 536, Verdi, Nev. 89439; Richard Munson, 1980 18th St., Sparks, Nev. 89431

[21] Appl. No.: 286,339

[22] Filed: Dec. 19, 1988

[51] Int. Cl.[5] ..... A63B 5/20

[52] U.S. Cl. ..... 272/75

[58] Field of Search ..... 272/74, 75, 93, 127, 272/128

[56] References Cited

U.S. PATENT DOCUMENTS

| | | | |
|---|---|---|---|
| 3,013,798 | 12/1961 | Willoughby | 272/74 |
| 3,411,775 | 11/1968 | Delk, Jr. | 272/75 |
| 3,468,534 | 9/1969 | Donato | 272/128 |
| 3,612,522 | 10/1971 | Ekonen | 272/75 |
| 4,201,382 | 5/1980 | Wilson | 272/75 |

FOREIGN PATENT DOCUMENTS

| | | | |
|---|---|---|---|
| 227726 | 10/1910 | Fed. Rep. of Germany | 272/74 |
| 2745145 | 12/1976 | Fed. Rep. of Germany | 272/74 |

*Primary Examiner*—Robert Bahr

*Attorney, Agent, or Firm*—Herbert C. Schulze

[57] ABSTRACT

A method and apparatus for providing rotation to a portion of a loop of rope by which an individual can jump rope alone, and without holding the rope, and in which the rope loops near the ground so that a jumper may jump over it, then rotate over the head of the jumper for another passage close to the ground, wherein a feature is a method for adjusting small weights on the rope to alter the characteristics of the loop; and safety provisions are made so that the rope will not become entangled with the user and cause injury. The apparatus comprises a stand with a fixed swivel arrangement to hold one end of a rope and a rotating device for the other end of the rope to cause the rotating motion of the loop and an adjustment can be made to accommodate different configurations of the loop as it passes beneath the jumpers feet and over the jumpers head.

1 Claim, 3 Drawing Sheets

FIG. 5.
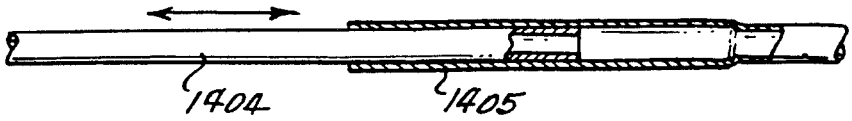
FIG. 4.
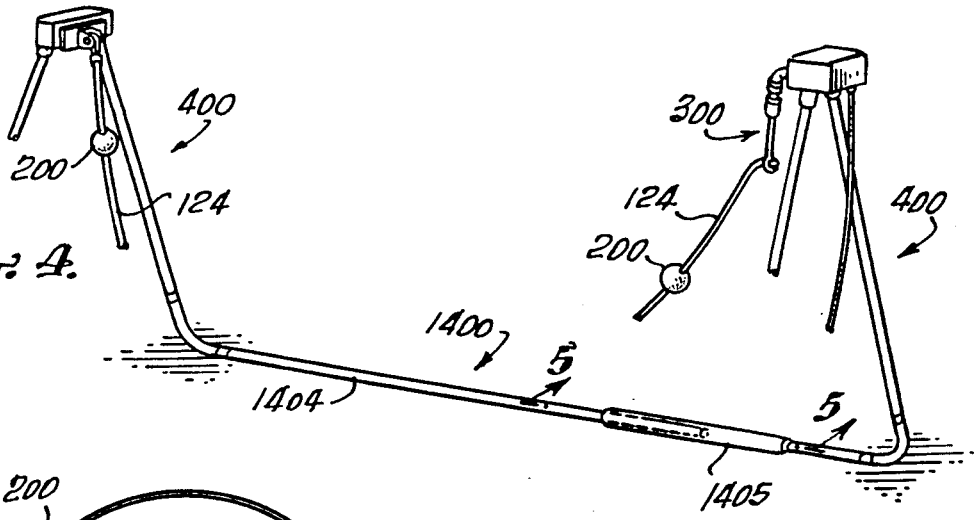
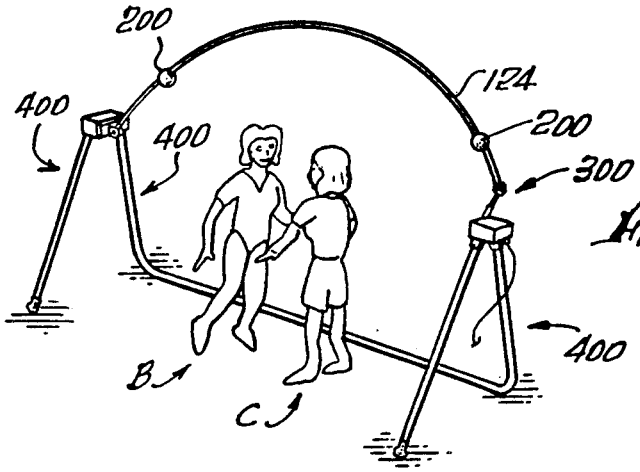
FIG. 6.
FIG. 7.
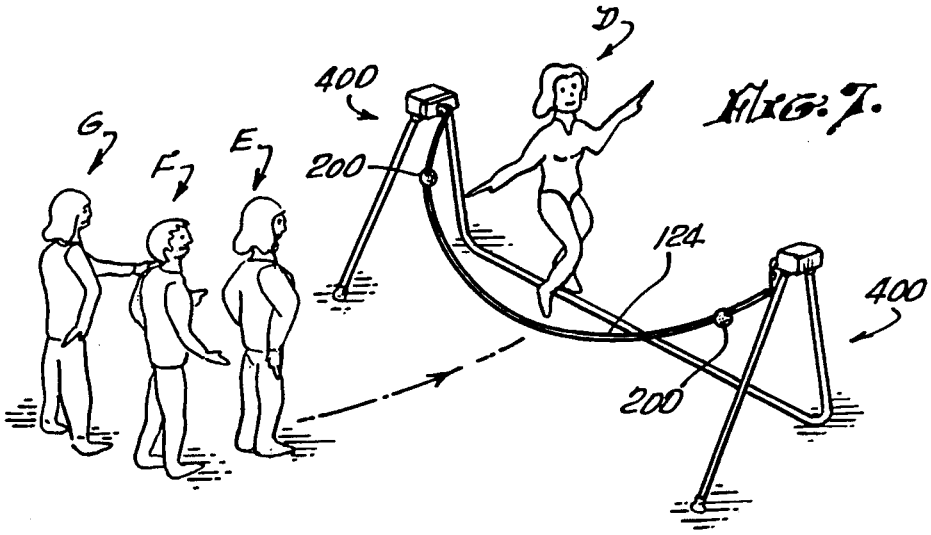

FIG. 8.
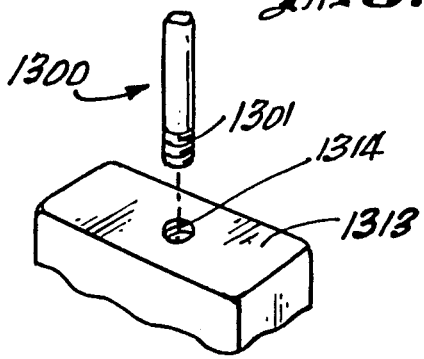
FIG. 9.
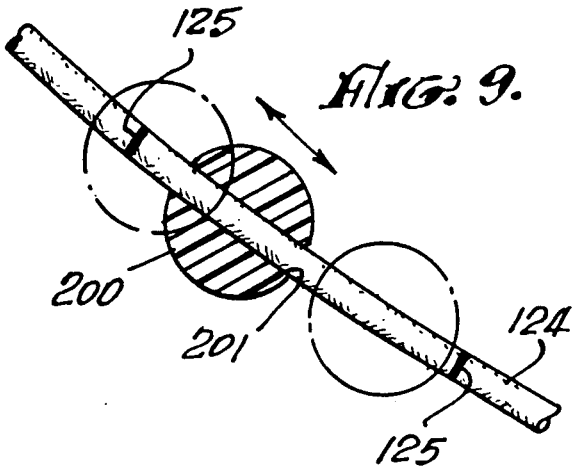
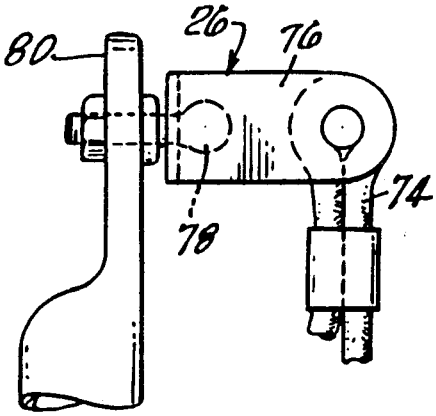
FIG. 11.
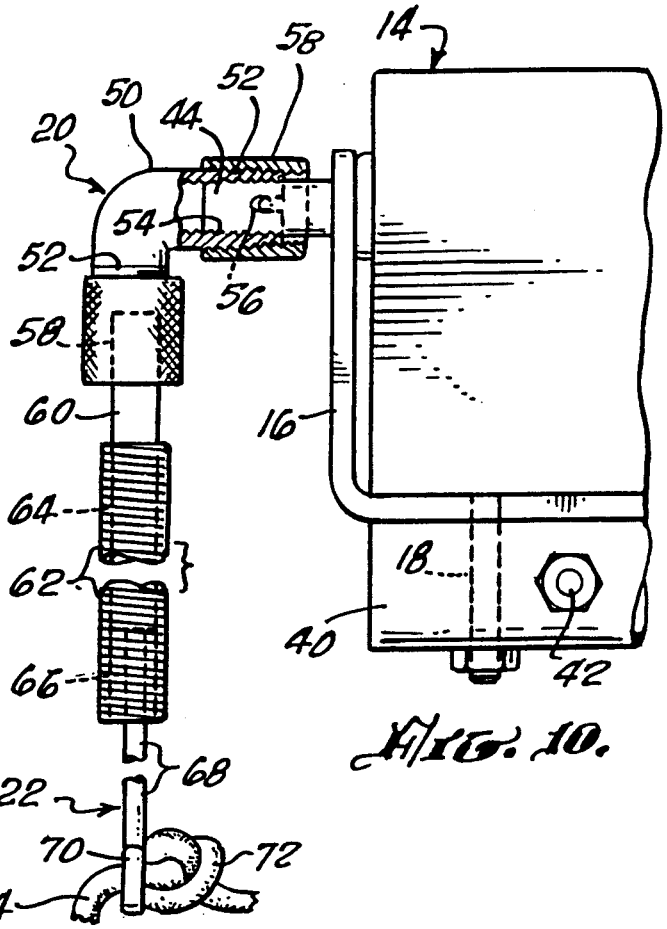
FIG. 10.

ROPE JUMPING METHOD AND APPARATUS

CROSS REFERENCE TO RELATED PATENT APPLICATIONS

There are no patent applications pending by us, or any of us, related to this application.

BACKGROUND OF THE INVENTION

1. Field of the Invention

This invention is in the general field of exercising and entertainment methods and apparatus;

The invention is more particularly directed to an exercising and entertainment method and apparatus wherein one individual, or a group of individuals, may engage in the activity without the necessity of any one individual being sidelined for purposes of turning the rope and wherein, no individual is required to turn the rope;

The invention is more particularly in the area of a method and apparatus by which the rope is caused to turn by power means independent of any participant in the game of rope jumping, and wherein the characteristics of the loop which is jumped can be altered readily.

2. Description of the Prior Art

There has been prior art in this field and most particularly and most closely related in the prior art is a jumping apparatus which is the subject of U.S. Pat. No. 3,612,522 by one of us (Martin A. Ekonen), which patent has now expired. In the patent referred to by Martin A. Ekonen (one of the present inventors) a loop of rope was caused to rotate in such manner as to allow a person to jump without being involved with the twirling of the rope and wherein a motor was utilized for this purpose. The motor was supported on a stand and carried one end of rope while the other end of the rope was affixed to an independent holding device such as some supporting structure, or held by another person, or by a post mounted in the ground. While this invention was a great advance in the art of rope jumping, it has now been superseded and outmoded by our present invention which incorporates many unique features; including a single, portable stand, not requiring an independent support member for one end of the rope, adjustably weighted rope for altering the characteristics of the loop formed, and safety magnetic breakaways to prevent the rope becoming a hazard to an individual using it. We know of no art particularly emphasizing these elements of the method and apparatus employed herein.

SUMMARY OF THE INVENTION

Currently throughout the world there is much emphasis on physical fitness and exercise and entertainment. The advantages of various types of exercise in maintaining physical fitness and in entertaining a user are well known.

A very entertaining and challenging exercise sport for persons of virtually all ages is jumping rope. This is recognized by athletes as well as by medical personnel and others.

Jumping rope is most commonly practiced wherein two people will twirl a rope in a loop closely approximating the surface upon which the jumper stands and then going overhead over the jumper's head. Also, and very commonly, rope jumping is accomplished by one individual holding two handles on the ends of a rope, or the ends of a rope itself, and twirling it by use of both hands over his head and under his feet. These methods of jumping rope are very usefull and well known. However, frequently, particularly with children, it is desired to play games such as having various people run one at a time through the loop and jump and then run in a circle so that a continual stream of persons is jumping, a different person at each passage of the rope. This presents an interesting timing and challenging sport wherein an individual who doesn't successfully make his jump and get out of the way for the next individual is penalized by a points system with a winner ultimately being determined.

Another variation is by altering the size of the loops sufficiently to have two persons jump at the same time within the same loop with one person facing, or not facing, the other, wherein points are scored based upon the number of times one jumper fails to make a jump while the other does make the jump.

A number of endless variations are available to those who like to enjoy this sport. Usually no one wants to be the idle person holding one or both ends of a rope and it is not feasible for the jumper, in these games, to be the one twirling the rope.

We have approached the problem of providing a method and apparatus for allowing groups of people, or individuals, to engage in rope jumping without the necessity of any individual being excluded from active participation, and in which all may compete in one manner or another. In approaching this problem we were required to provide a means by which a rope could be twirled through the air and then close to the ground in a uniform manner. Further, we were required to provide a means to alter the shape of the loop through which persons jumped to accommodate different sized individuals and different numbers of individuals. This became a difficult task which we finally solved by the use of two small weights adjustably mounted upon the rope. This took a great deal of experimentation and required weights which would not hurt an individual if he was hit by one of them in one passage of the rope.

Further, we then had to provide a system for disengaging the rope upon interference with a jumper so that one jumper jumping alone or a number of jumpers jumping together would not be injured as a result of becoming entangled with the rope by failing to jump over it. This we accomplished by the use of a magnetic breakaway device holding at least one end of the rope.

Still another matter to which we had to address ourselves was to provide for changing the distance between the ends of the rope as the nature of the loop was changed since in one instance the loop will be like an oval, or egged shaped, and in another instance it will be fundamentally round. This we accomplished by a readily adjustable stand to hold the rope.

It is an object of this invention to provide a method and apparatus by which a single individual or a group of individuals may engage in a game, or contest, while jumping rope;

Another object of this invention is to provide a method and apparatus by which the nature and character of the rope being used for jumping can be changed as desired to accommodate one or more individuals at the same time, or one or more individuals at alternate times, or wherein the entire nature of the loop may be altered;

Another object is to provide safety means to prevent injury by entanglement with a rope being used for rope jumping.

The foregoing and other objects and advantages will become apparent to those skilled in the art upon reading the description of a preferred embodiment which follows in conjunction with a review of the appended drawings.

BRIEF DESCRIPTION OF THE DRAWINGS

FIG. 4 is a schematic perspective of an alternate adjustable frame used in the method and apparatus of the invention;

FIG. 5 is an enlarged partially sectioned broken away view on 5—5 of FIG. 4;

FIG. 6 illustrates more than one person utilizing the apparatus and method of this invention;

FIG. 7 illustrates multiple numbers of jumpers in sequence using the method and apparatus of this invention;

FIG. 8 is a broken away exploded view of an apparatus to turn the rope;

FIG. 9 illustrates a method of marking the adjustable weights upon the rope utilized in this invention;

FIG. 10 illustrates in more detail the apparatus utilized for turning the rope; and FIG. 11 illustrates the swivel connection to the rope.

DESCRIPTION OF A PREFERRED EMBODIMENT

Figure 1:
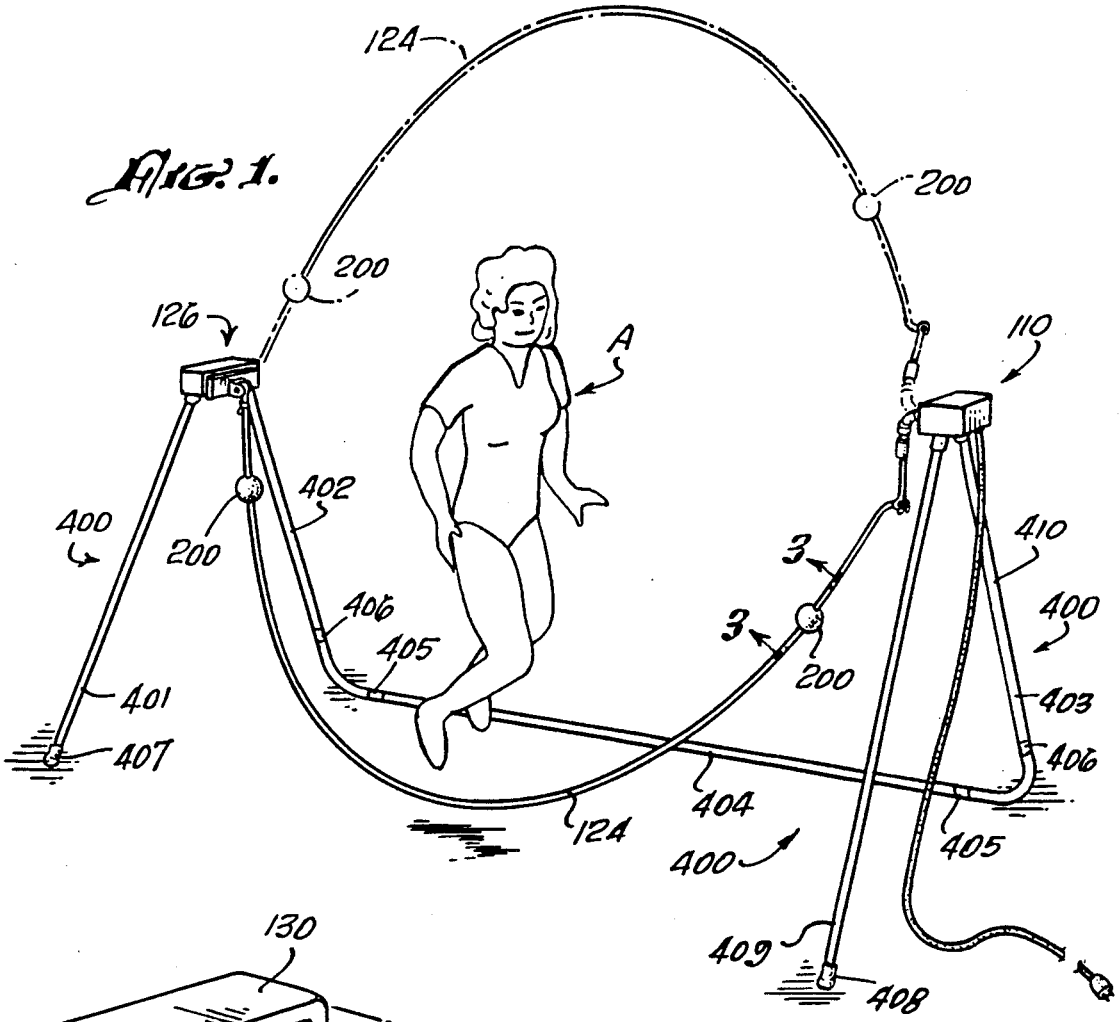
FIG. 1 is a perspective of a person practicing the method of this invention.

FIG. 1 shows a person A practicing the method of this invention and utilizing the apparatus of this invention wherein the apparatus generally 400 consists of a frame having legs 401, 402, 403, and 409, which supports a turning mechanism 110 and rope holding mechanism 126 as indicated. The portions heretofore mentioned are joined together by an extension 404 which rests upon the ground and the members 401 and 409 rest upon the ground at 407 and 408. Connectors 405 and 406 make it possible to disassemble and easily transport the unit.

It is seen that the rope 124 has two weights 200. These weights are extremely important because they allow for adjustment of the loop size.

Figure 2:
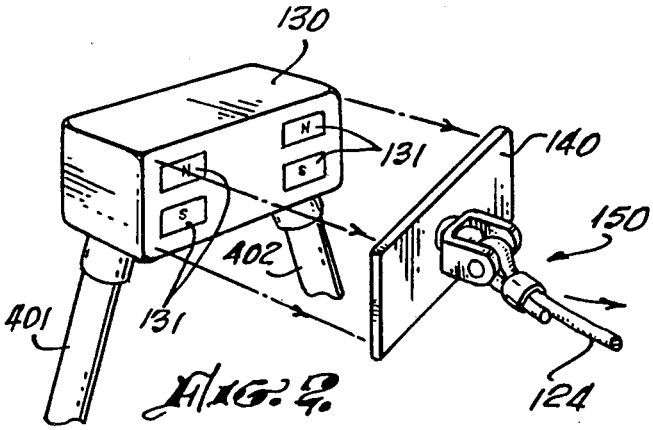
FIG. 2 is a detailed perspective description partly schematic of the area 110 of FIG. 1.

In FIG. 2 there are illustrated magnetic elements 131 fastened to a base arrangement 130 which in turn is shown to be mounted upon the legs 401 and 402. A magnetic or magnetic attracting plate 140 is shown and a swivel arrangement at 150 is shown for holding the rope at 150.

Figure 3:
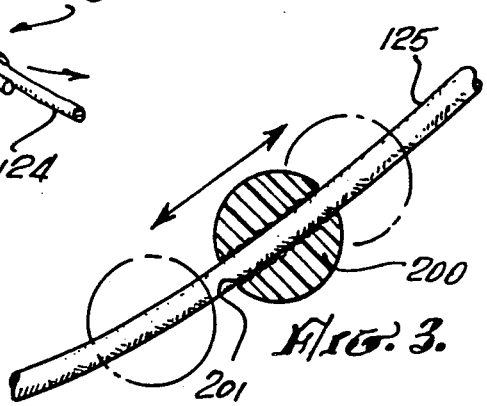
FIG. 3 is a schematic partially sectioned view on 3—3 of FIG. 1.

FIG. 3 shows how the balls 200 are mounted upon the rope so they can be moved. Balls are preferably of soft rubber so they cannot injure a jumper if they should strike the jumper.

FIGS. 4 and 5 illustrate a method of adjusting the distance between the rope turning end and the rope holding end of the frame. It will be noted that the frame generally 400 has the same elements as previously illustrated with the rope turning mechanism indicated at 300. The frame bar member 1404 replaces the bar member 404 as shown in FIG. 1. Its adjustment is through a friction sleeve 1405 as is illustrated and will be clear to those who are familiar with the art.

FIG. 6 illustrates the use of the apparatus by two individuals B and C respectively. In this case the loop has been adjusted by means of adjustment of the balls 200 so that it is describing a much broader loop in order for two persons to be accommodated facing one another at the same time.

FIG. 7 illustrates the use of the method and apparatus of this device by a number of individuals D, E, F, and G each running through jumping once or twice depending upon what rules are set down by the individuals playing and then the next person must run in while the first person jumps out so as to not miss one passage of the loop of rope. This makes a very interesting game and is quite entertaining for young people particularly.

FIG. 8 is a rope holding device in which the rope is twirled or rotated. The rotating bar 1300 will take the place of the rotating bar 60 etc in FIG. 10 which will be explained in further detail. In this case the rotating bar 1300 has threads 1301 and has a block 1313 attached to it wherein the block 1313 has a tapped hole 1314 so that the block may be screwed on to the rotating bar 1300. The block 1313 is broken away but what it will be is a virtual duplicate of the block 130 in FIG. 2 and the rope will be held by a plate such as 140 with a swivel connection if desired at 150 as indicated. In this case then the rope end which is rotating will be held by a magnet so that if anyone should be entangled with the rope the magnet will break away from the plate and then the rope will be harmless.

FIG. 9 shows a method of marking the rope by marks at predetermined intervals such as 125 so the ball can be moved from each end in an identical manner and for an identical distance and quite accurately maintain the proper attitude of the loope which is formed.

FIGS. 10 and 11 are virtually identical, but mere image presented, to FIGS. 2 and 3 of the aforereferenced U.S. Pat. No. 3,612,522. These elements illustrate the usage wherein we originally invented and will also illustrate the changes by comparison which we have now incorporated. It will be recited exactly as recited in this previous U.S. Pat. No. 3,612,522 and it will be understood that the rope which was 24 in the old U.S. Pat. No. 3,612,522 is of course now 124. The reason for showing these illustrations is to make clear the improvements which have been made and it is to be understood that the rotating of the rope will be accomplished by the same type of mechanism as set forth there.

We claim:

1. The method of jumping rope comprising providing a frame having two upstanding ends at a spaced distance from one another said frame being suitable to rest upon a jumping surface mounting a motor driven rope holding device on one of the upstanding ends of said frame and mounting a swiveler rope holding device on the other upstanding end of said frame; activating the motor; providing two weights upon said rope at a spaced distance from one another and in such manner as to be adjustable toward and away from one another; adjusting said weights so as to adjust the nature of a loop formed by the tope in its travel just above the jumping surface and in the area above the head of a person jumping the rope; and causing said upstanding ends on said frame to be moved relative to one another by means of extensible frame members so as to maintain uniform height above the jumping surface of a loop of the rope when rotated regardless of the shape of the loop of the rope; and wherein said frame is provided with an opening on one side thereof so that a person may enter beneath a rope held by said upstanding means without interfering with, or stepping upon, or crossing over any portion of said frame and wherein a break away connection is provided intermediate the rope and the swivel connection wherein the break away connection consists of a block of magnetic material mounted to the upstanding ends not containing the motor and wherein the swiveler rope holding device is mounted upon a magnetically attractable plate held against said magnetic block in such manner that if excessive force is applied the plate will break away from the magnetic block.

* * * * *